US005078202A

United States Patent [19]

Bai

[11] Patent Number: 5,078,202

[45] Date of Patent: Jan. 7, 1992

[54] FLOATING WEDGE LOCK FOR SLIDE ON MOVABLE DIE

[75] Inventor: Shen H. Bai, Toledo, Ohio

[73] Assignee: Doehler-Jarvis Limited Partnership, Toledo, Ohio

[21] Appl. No.: 583,464

[22] Filed: Sep. 17, 1990

[51] Int. Cl.[5] ..... B22D 33/04

[52] U.S. Cl. ..... 164/342; 164/341

[58] Field of Search ..... 164/341, 342; 425/DIG. 5, DIG. 58, 451.7, 451.9, 595, 577; 249/165, 160

[56] References Cited

U.S. PATENT DOCUMENTS

| | | | |
|---|---|---|---|
| 1,993,438 | 3/1935 | Flammang et al. . | |
| 2,286,994 | 6/1942 | Nocar . | |
| 2,287,524 | 6/1942 | Jackson . | |
| 2,521,520 | 9/1950 | Jancura . | |
| 2,553,744 | 5/1951 | Brammer . | |
| 2,696,031 | 12/1954 | Fouron et al. . | |
| 2,780,849 | 2/1987 | Berry . | |
| 3,283,374 | 11/1966 | Peras . | |
| 3,324,936 | 6/1967 | Bauer | 164/314 |
| 3,595,301 | 7/1971 | Bauer | 164/113 |
| 3,720,397 | 3/1973 | Voegele | 249/57 |
| 4,492,264 | 1/1985 | Gaddi | 164/292 |
| 4,592,405 | 6/1986 | Allen | 164/120 |
| 4,889,480 | 12/1989 | Nakamura et al. | 425/451.7 |
| 4,919,189 | 4/1990 | Sato et al. | 164/137 |

FOREIGN PATENT DOCUMENTS

| | | | |
|---|---|---|---|
| 225948 | 8/1985 | Fed. Rep. of Germany | 425/577 |

*Primary Examiner*—Kuange Y. Lin

*Attorney, Agent, or Firm*—Hugh Adam Kirk

[57] ABSTRACT

This disclosure concerns dies for die casting machines having a stationary or cover die and a movable or ejector die which has a movable slide mounted thereon. A tapered trough is provided across the slide and into opposite sides of the movable die, and the cover die is provided with a floating wedge that fits into the full length of this trough for positioning and locking the slide with respect to the movable die on which this slide is mounted. The floating wedge may be held in the cover die by flanges on the wedge which loosely fit in grooves in the cover die. The tapers on the wedge and the sides of the trough are complimentary for locking the movable die parts together when all the die parts are closed for filling the cavity formed by the die parts with molten metal.

13 Claims, 4 Drawing Sheets

FLOATING WEDGE LOCK FOR SLIDE ON MOVABLE DIE

BACKGROUND OF THE INVENTION

It is well known that die parts may be locked into position by wedges and/or hook means as shown, for example, in Gaddi U.S. Pat. No. 4,492,264 issued Jan. 8, 1985 and Allen U.S. Pat. No. 4,592,405 issued June 3, 1986, and even having a floating wedge means as disclosed in Bauer U.S. Pat. No. 3,324,936 issued June 13, 1967. Cooperating tapered slides for holding movable dies in position when the dies are closed are also well known as shown by the above mentioned patents. However, there is no known means in which a floating wedge is employed to position and lock a slide mounted in and to a movable die in the positive manner disclosed herein.

SUMMARY OF THE INVENTION

Generally speaking, this invention relates to a die casting die having a stationary or cover die and a cooperating movable or ejector die, which movable or ejector die is provided with one or more slides mounted thereon. The improvement of this invention involves a floating wedge means mounted on the stationary or cover die for positioning and locking the slide or slides on the movable die to the movable die when the dies are in their closed positions. Thus there is provided a trough across or transverse to the movement of the slide in the slide, which trough extends into the movable die on both sides of the slide. This trough has tapered sides that cooperate with the tapered sides of the wedge floatingly mounted on the stationary or cover die. This mounting for the wedge means may comprise outwardly extending flanges at the base of the wedge means, which flanges fit loosely into grooves provided therefor in the cover or stationary die. The tapered sides of the wedge means compliment and fit the tapered sides for the full length of the trough. A plurality of such slides may be mounted on a single ejector or movable die, with each slide having a transverse trough and separate cooperating floating wedges mounted on the stationary or cover die. Thus, the interfitting of the floating wedge or wedges into the trough or troughs across the movable slides, not only position, but also lock the slides in position relative to the movable die on which they are mounted.

OBJECTS AND ADVANTAGES

Accordingly, it is an object of this invention to produce an efficient, simple, effective, economic, and durable die casting die with movable slides mounted on the movable die that are independently positioned and aligned.

Another object is to produce such a die in which the movable parts thereof are locked into position, thereby reducing the accumulation of contact die surface variances, eliminating conflicting forces of different die contact surfaces, and eliminating galling between the die parts.

Another object is to produce such a die with movable die parts which improves the dimensional control capability of the parts formed in the die.

A further object is to produce such a die with movable die parts that substantially reduce casting pressure and thermal growth effect to die alignment.

BRIEF DESCRIPTION OF THE VIEWS

The above mentioned and other features, objects and advantages and a manner of attaining them are described more specifically below by reference to an embodiment of this invention shown in the accompanying drawings wherein.

DETAILED DESCRIPTION OF PREFERRED EMBODIMENT

Figure 1:
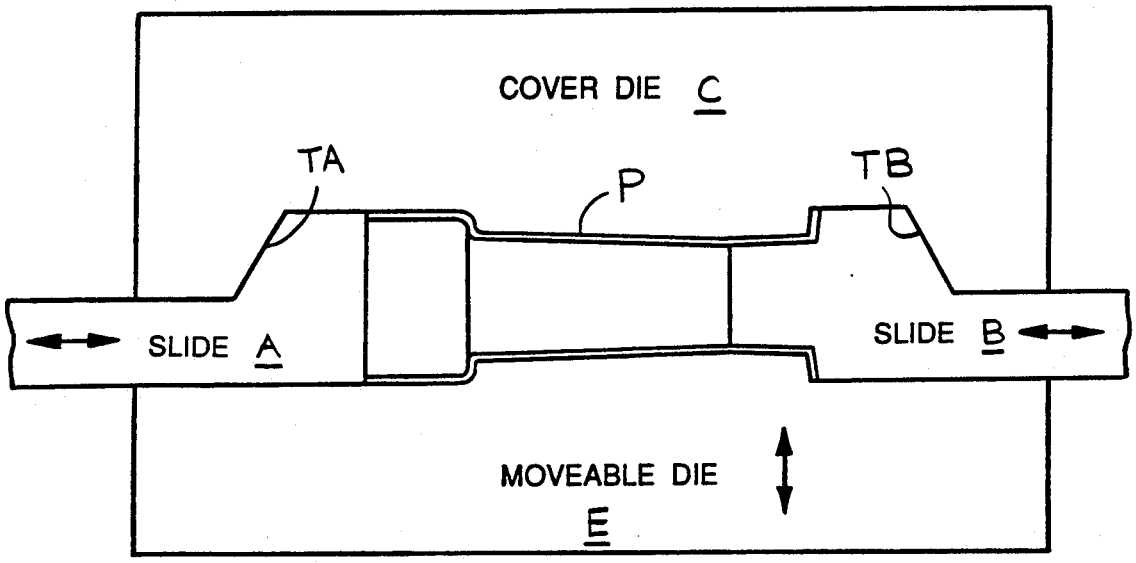
PRIOR ART FIG. 1
FIG. 1 is a schematic cross-section showing a means previously employed for positioning slides on a movable die by cooperating tapered surfaces between a cover die and two opposing slides mounted on a movable die.
Figure 2:
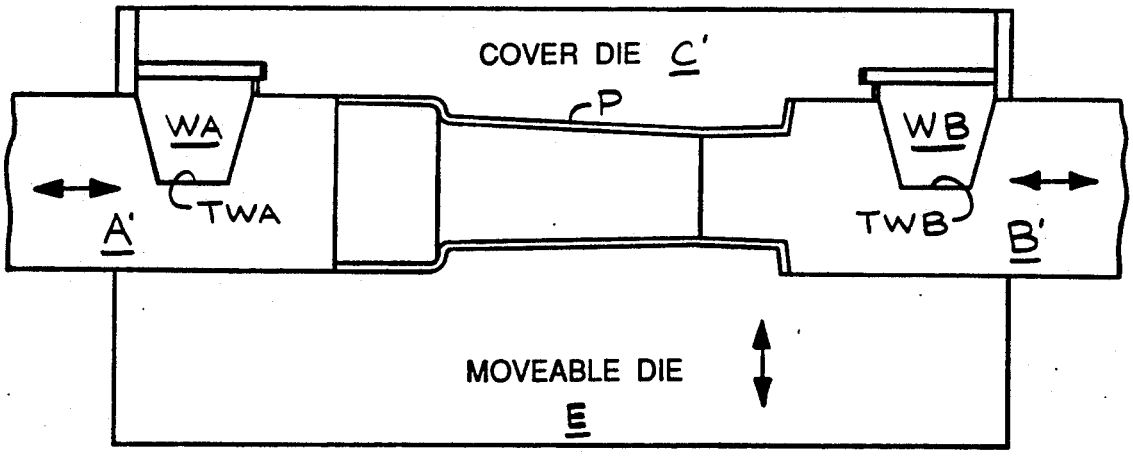
FIG. 2 is a schematic cross-section similar to that shown in FIG. 1 but employing the locking wedge means according to the present invention for positioning and locking the slides mounted on a movable die.

Referring first to FIGS. 1 and 2 for comparison between the prior art and the present invention, respectively, there is shown in FIG. 1 a stationary or cover die C closed against a pair of opposite slides A and B mounted on a movable or ejector die E for forming a part P. There are also shown cooperating tapers TA and TB between the cover die C and the slides A and B for urging the slides into position relative to the stationary die C. Since there is often different forces applied to a slide A than to slide B, alignment difficulties can readily occur between the movable and stationary die parts A, B, C and E.

In order to eliminate these undesirable factors, there is shown in FIG. 2 a partial disclosure of applicant's invention in which the movable slides A' and B' are provided not only with single taper, but a double taper or trough TWA and TWB into which floating wedges WA and WB, respectively, mounted in the cover die C', lockingly fit when the dies are in their closed position as shown in FIG. 2. Furthermore, the wedges and troughs shown herein extend completely across the slides A' and B' and into corresponding trough parts in the movable die E as is better shown in FIGS. 3 and 4 of the description of this invention. Thus the cooperating wedges WA and WB in troughs TWA and TWB shown in FIG. 2 not only position the slides A' and B' with respect to the movable die E, but also lock the movable slides A' and B' in their corresponding positions independently of the pressure stresses that may be unequally applied to the separate slides.

Figure 3:
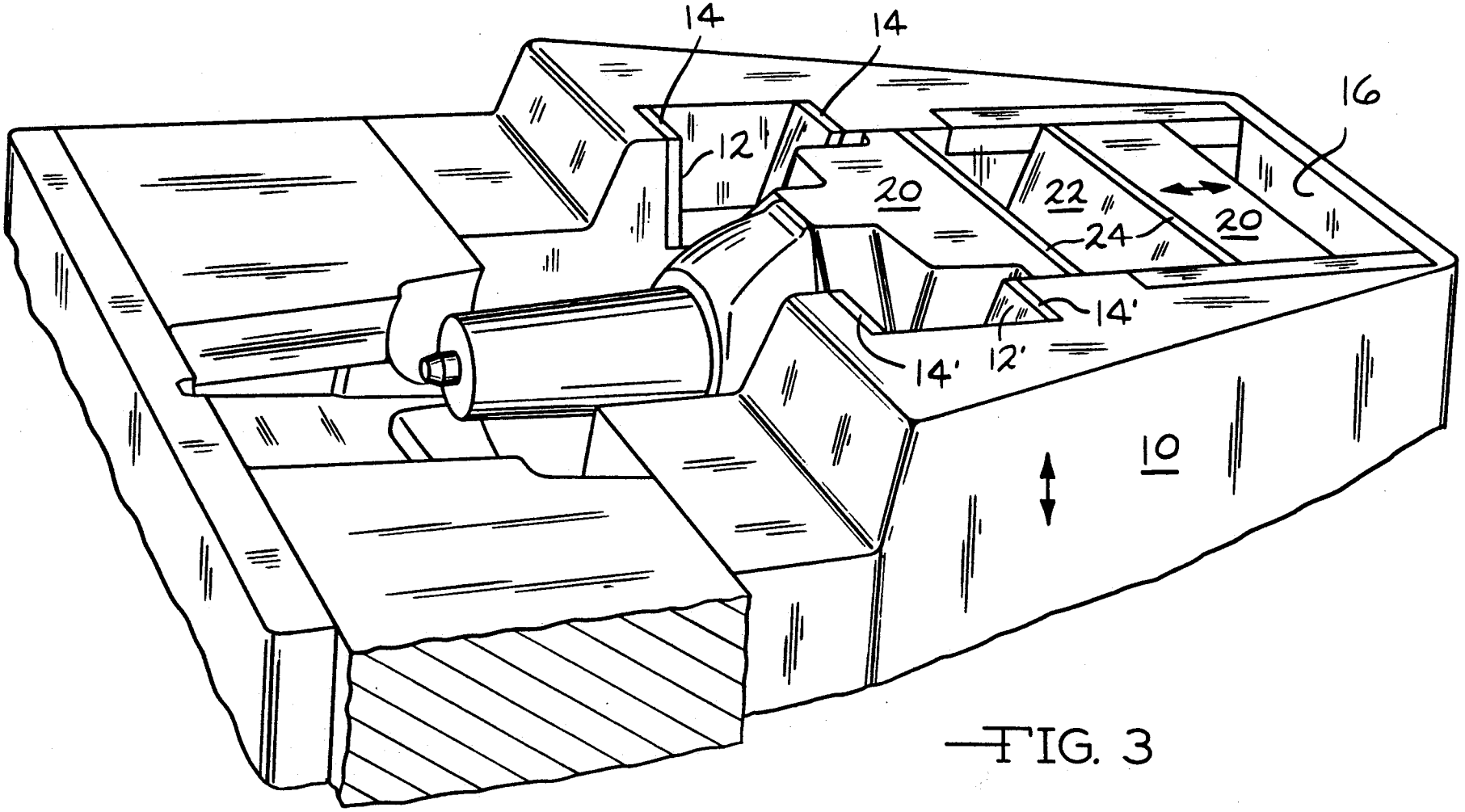
FIG. 3 is a perspective view of a movable die for forming a transmission housing having a movable slide mounted thereon with a transverse groove therein showing the slide in its open or retracted position.
Figure 4:
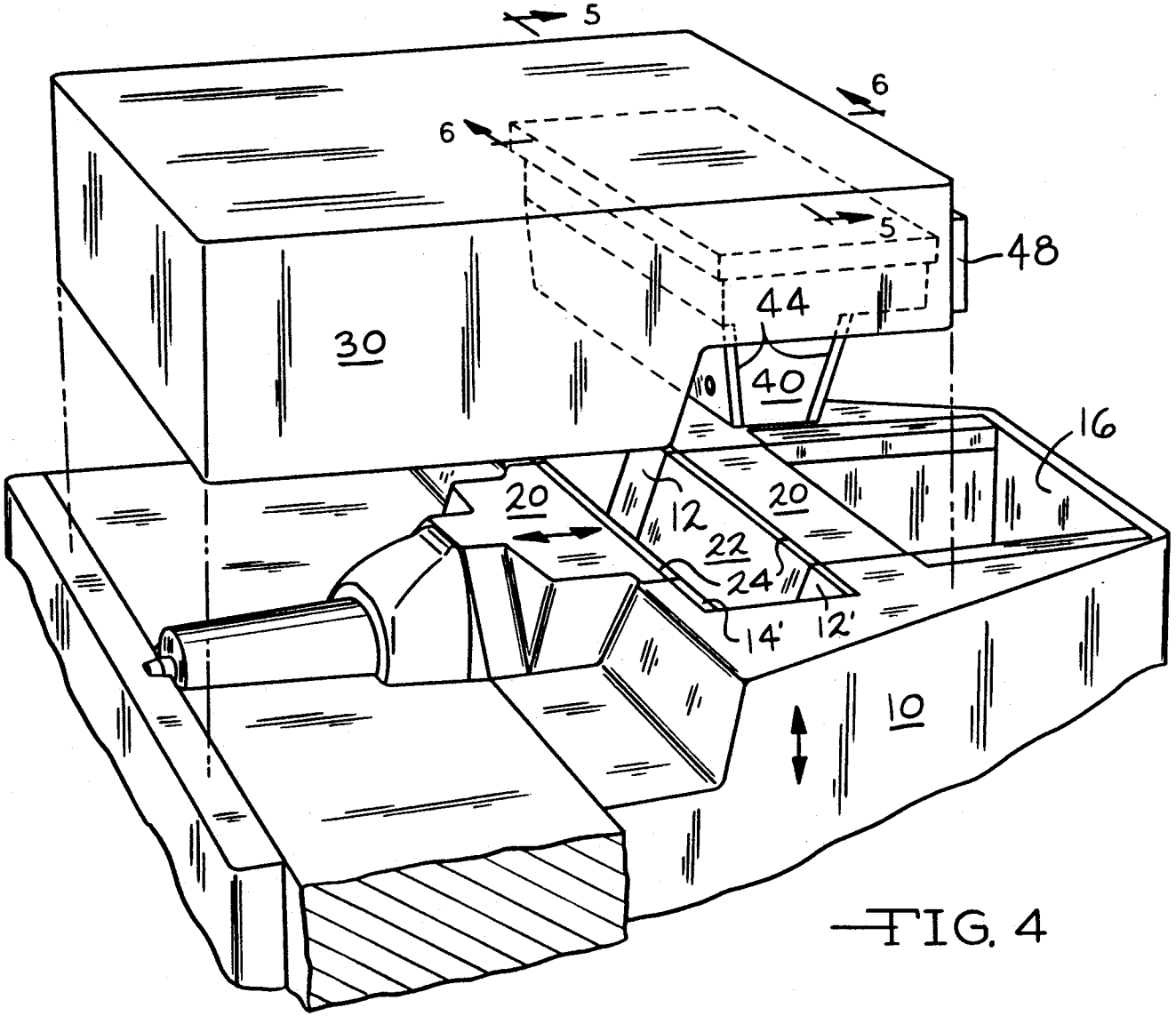
FIG. 4 is a slightly reduced perspective view of the movable die in FIG. 1 but with its slide closed, and its cover die mounting the floating wedge positioned above the trough in the cover die ready for locking the slide to its movable die.

Referring now more specifically to FIGS. 3 and 4, there is disclosed a movable die 10 having mounted therein a slide 20 transversely across which is a trough 22, which trough, when the slide 20 is in its closed position, extends into the movable die 10 trough portions 12 and 12' to form a continuous trough 12, 22 and 12' as shown in FIG. 4 when the slide 20 is in its closed position. Above the movable die 10 in FIG. 4 is shown a portion of the stationary or cover die 30 which floatingly or loosely carries the wedge 40 that fits into the full length of the trough 12, 22, 12'. The cooperating tapered sides of the trough 12, 22, 12' and the tapered sides of the wedge 40 may have wear plates 14, 24, 14' in the trough 12, 22, 12' and wear plates 44 on the wedge 40. If desired, these wear plates may be coated with a silicone or other suitable lubricant to facilitate their positioning and locking functions when the die parts are being closed.

The arrows shown in FIGS. 3 and 4 on the die parts 10 and 20 indicate the direction of movements of the movable die 10 and its slide 20 in a trough 16 in the movable die part 10.

Figure 5:
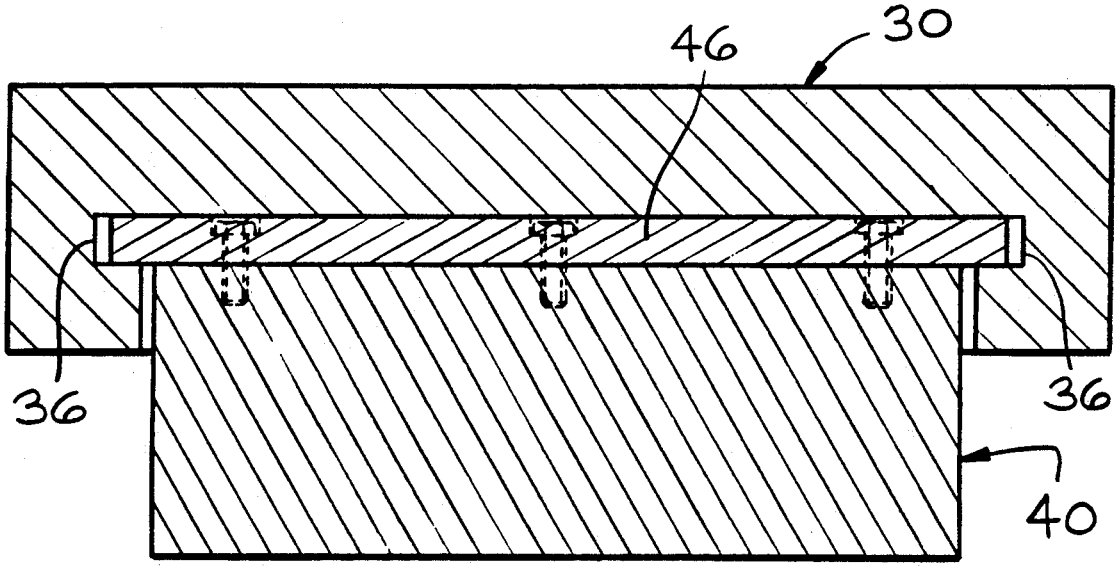
FIG. 5 is an enlarged sectional view taken along line 5—5 of FIG. 4 showing a flange plate mounted on the wedge, loosely fitting in the grooves provided therefor, in the stationary die.
Figure 6:
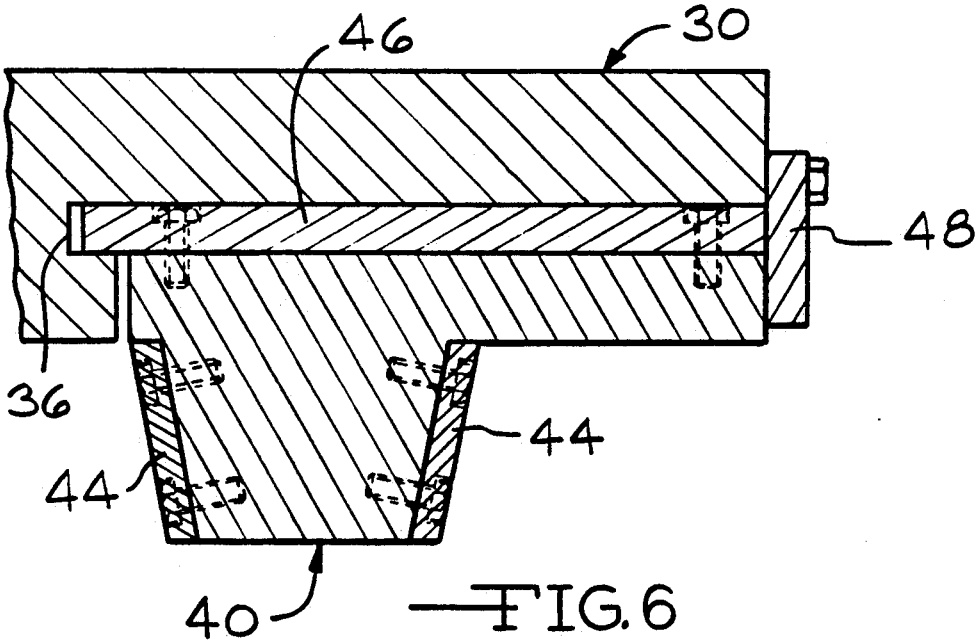
FIG. 6 is an enlarged vertical sectional view taken along line 6—6 of FIG. 4 showing the plate for preventing the wedge from sliding out of its grooves in the stationary die.

FIGS. 5 and 6, which are enlarged sections taken along lines 5—5 and 6—6, respectively, of FIG. 4, show one construction of the wedge means 40 comprising a larger-area top plate 46 bolted to the base of the wedge 40 and forming overhanging side flanges which are held loosely in grooves 36 in the cover die 30. These grooves 36 are deeper than the flanges overhang the edge base of the wedges 40, which permits the wedge 40 to float in both directions in a plane parallel to the parting plane between the movable die 10 and cover die 30. As shown in FIG. 6, the wedge 40 and its top plate 46 may be held in the stationary die 30 by a cover plate 48 bolted to a side of the cover die 30 and overlapping an edge of the wedge 40 and its top plate 46. This cover plate 48 permits easy replacement of the wedge means 40 if and when such becomes necessary.

It is to be understood that the floating wedge means and cooperating troughs shown in the drawings and described above are made only by way of example in that different shape and size troughs and cooperating wedge means may be provided on other shaped dies for performing the same function, without departing from the scope of this invention. Furthermore, one or more or all of the slides on a movable die part may be provided with the floating wedge means and trough positioning and locking means of this invention. Although this particular die has been adapted and shown for a high pressure die casting machine for producing transmission housings, the inside form of which is shown in the movable slide 20 in FIGS. 3 and 4, it is to be understood that this principle is applicable to other type product dies and with additional slides.

While there is described above the principles of this invention in connection with specific apparatus, it is to be clearly understood that this description is made only by way of example and not as a limitation to the scope of this invention.

I claim:

1. In a multi-part die casting die comprising:

a) a movable die part, b) a movable slide die part movable in said movable die part, and c) a cover die part cooperating with said movable die parts to form a die cavity when all said die parts are in their closed positions, the improvement comprising:

d) a positioning and locking means comprising a trough means across said slide die part into said movable die part, and e) a floating wedge means held in said cover die part which wedges into the full length of said trough means for independently locking said movable slide die part to said movable die part.

2. A multi-part die according to claim 1 wherein said trough means and said wedge means have cooperating tapered sides.

3. A multi-part die according to claim 2 wherein said tapered sides include wear plates.

4. A multi-part die according to claim 2 wherein said floating wedge means includes a flange for holding said wedge means in said cover die part.

5. A multi-part die according to claim 4 wherein said cover die has opposing undercut grooves for loosely seating said flange of said floating wedge means.

6. A multi-part die according to claim 1 comprising a plurality of movable slide die parts mounted on said movable die part and each having its own said independent positioning and locking means.

7. In a multi-part die casting die comprising:

a) a movable die, b) a slide movable in said movable die, and c) a cover die cooperating with said movable die and said slide to form a die cavity when said dies are in their closed position; the improvement comprising:

d) a trough with at least one outwardly tapered side, which trough extends across said slide and into both sides of said movable die adjacent said slide, and e) a floating wedge held in said cover die which wedges into said trough for positioning and locking said slide in said movable die when said dies are closed.

8. A multi-part die according to claim 7 comprising a plurality of slides movable in said movable die.

9. A multi-part die according to claim 8 wherein said movable die and each of its slides have said tapered troughs.

10. A multi-part die according to claim 9 wherein said cover die has a floating wedge corresponding to each of said troughs.

11. A multi-part die according to claim 7 wherein said trough has cooperating tapered sides corresponding to the slides of said floating wedge.

12. A multi-part die according to claim 7 wherein said floating wedge includes a flange along its inner sides for holding said wedge in said cover die.

13. A multi-part die according to claim 12 wherein said cover die has opposing undercut grooves for loosely seating said flange of said floating wedge.

* * * * *